United States Patent [19]

Kumar et al.

[11] 4,445,989

[45] May 1, 1984

[54] CERAMIC ANODES FOR CORROSION PROTECTION

[75] Inventors: Ashok Kumar, Champaign; Ellen G. Segan; John M. Bukowski, both of Urbana; Jon L. Helgeland, Champaign, all of Ill.

[73] Assignee: The United States of America as represented by the Secretary of the Army, Washington, D.C.

[21] Appl. No.: 407,189

[22] Filed: Aug. 11, 1982

[51] Int. Cl.[3] ..... C23F 13/00

[52] U.S. Cl. ..... 204/147; 204/196; 204/290 F

[58] Field of Search ..... 204/147, 196, 290 F

[56] References Cited

U.S. PATENT DOCUMENTS

| | | | |
|---|---|---|---|
| 3,103,484 | 9/1963 | Messner | 204/290 F |
| 3,711,397 | 1/1973 | Martinsons | 204/291 |
| 3,850,701 | 11/1974 | Itai et al. | 204/290 F |
| 4,132;619 | 1/1979 | Klein et al. | 204/290 F |
| 4,169,028 | 9/1979 | Yokoyama et al. | 204/196 |
| 4,243,497 | 1/1981 | Nicolas et al. | 204/290 F |

FOREIGN PATENT DOCUMENTS 2018290 10/1979 United Kingdom .

OTHER PUBLICATIONS

Fujii et al., Anodic Behavior of Ferrite—Coated Titanium Electrodes—Corrosion Engineering—vol. 29, No. 4, pp. 180–184, 1980.

*Primary Examiner*—T. Tung

[57] ABSTRACT

An anode useful in corrosion protection comprising a metallic substrate having an applied layer thereon of a ferrite or a chromite, said layer having metallic electronic conductivity and a thickness of at least 10 mils (254 μm).

7 Claims, 2 Drawing Figures

CERAMIC ANODES FOR CORROSION PROTECTION

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

1. Field of the Invention

This invention relates to anodes that are useful for cathodic protection against corrosion. These anodes are particularly intended for use in the protection against corrosion of lock gates in canals, elevated water-storage tanks, and of underground pipes and pipelines, and are of potential use with submarines, ships, and off-shore structures such as oil well drilling platforms.

2. Description of the Prior Art

The corrosion of metallic structures that are buried in the soil or that are immersed in water can be reduced or stopped by cathodic electroprotection. This is accomplished by applying a small electric current from an outside source to the structure that is subject to corrosion. One ampere of applied current will stop corrosion on 500 square feet of uncoated steel, for example.

In cathodic electroprotection, the current is applied through an anode. The anode is connected electrically to a source of positive potential, and is disposed in the soil or sea water so that it is not directly electrically connected to the metallic structure that is to be protected, although it may be mounted on that structure. The metallic structure in turn is connected to a negative source of potential. The anode thus is the positive terminal in the corrosion battery, and the structure is the negative terminal.

In cathodic electroprotection, when an electrical circuit is established between the anode and the structure that is to be protected, through an electrolyte, the resulting current flows from the anode to the structure. This flowing current maintains the structure cathodic at the expense of the anode. The anode is progressively dissolved or sacrificed, so that corrosion of the structure is reduced or prevented.

For the past several years, silicon-iron and graphite have been in widespread use in the cathodic electroprotection anode. These materials are brittle, and have consumption rates on the order of about 1 pound per ampere year. That is, if one ampere of current is passed through the anode for one year, about 1 pound of the anode will be consumed. Consequently, when these materials are used, large anodes are required. Such large anodes are vulnerable to damage from debris and ice, and are also prone to field installation problems.

Other electrically conducting materials have been proposed and used as anodes in cathodic electroprotection systems. These include platinum and platinum-coated titanium or niobium. While reference is made herein to titanium and niobium, generally even the commercially available materials that are considered to be substantially pure titanium and niobium metals are alloyed at least with minor amounts of other materials, and it should be understood that all references herein to these two metals in particular refer to the commercially available 98 to 100 percent pure metals. These substrate materials are essentially inert under the electrolysis conditions.

Platinized anodes are a recent innovation in the cathodic protection industry. These anodes employ an extremely thin film of platinum, on the order of 10 microns thick, over valve metal substrates, such as titanium, niobium and tantalum. When immersed in water, these valve metals are passivated and form an insulating film that does not break down at the normal operating voltages encountered in cathodic protection. The thin layer of platinum that is deposited on the substrate metal stops the formation of the insulating film on the valve metal and allows current to flow. If the platinum layer is scratched, the freshly exposed substrate metal passivates and stops passing current from the scratched area, but nevertheless continues to pass current from the rest of the platinum-coated substrate area. The consumption rate of platinum is on the order of 5–6 milligrams per ampere year. The high cost of platinum makes the platinized anodes expensive and that is why platinum is used in extremely thin layers. The thinness of these layers makes these anodes susceptible to abrasion damage and erosion-corrosion damage.

As is pointed out in British patent application No. 2,018,290 A, published Oct. 17, 1979, partly-inert materials such as lead alloys or silicon-iron, and materials such as scrap iron or aluminum, are in fact attacked or take an active part in the cathodic electroprotection process. Electron-conducting non-metallic materials such as graphite and magnetite, $Fe_3O_4$, are also used as anode materials for certain applications.

According to the British patent publication, an anode that is to be used for cathodic electroprotection ideally should be completely inert, even at high current densities; it should not polarize significantly; it should have a high electrical conductivity; it should be mechanically stable, and it should be economical. Stating the requirements for a good anode material somewhat difficulty than the British patent publication, the material for the anode should have essentially metallic conductivity, that is, the electrical conductivity that characterizes the more common metals, and in addition, it should have a low dissolution rate. The British patent publication sought to meet these requirements by forming an anode from a composite of magnetite with either lead or a lead alloy. In this composite, small particles of magnetite were dispersed in a matrix of the lead or the lead alloy.

Certain ceramic materials that are electron-conducting, such as the ferrites, exhibit dissolution or consumption rates that re many times less than those of the currently used silicon-iron and graphite materials often used in anodes. The ferrites have not gone into general use for this purpose in the past, howver, because ceramics are extremely brittle and cannot be fabricated readily.

Conducting ceramic anode coatings must provide an effective barrier to oxygen ions, so that the substrate metal does not become oxidized. In addition, the ceramic coating must have a relatively high electron conductivity. The coating must have an active surface area for oxidation to occur. The ceramic coating must also be mechanically strong and have good adherence to the substrate.

A past attempt to use magnetite as an anode material, in the form of a coating over a titanium or tantalum substrate, is described in U.S. Pat. No. 3,850,701. The magnetite was formed into a layer by a chemical process, with a thickness in the range from about 3 μm to about 20 μm. The magnetite layer was formed by electrodepositing iron onto a substrate of titanium, zirconium, tantalum, or niobium, and then applying a chemical treatment to the deposited iron to convert it to magnetite. This is not considered to be completely satisfactory, because of insufficient coating thickness and adhesion.

A Japanese publication by the authors, T. Fujii, T. Kodama, H. Baba, and S. Kitahara, "Anodic Behaviour of Ferrite-Coated Titanium Electrodes, Boshoku Gijutsu" (*Corrosion Engineering*), Vol. 29, 180–184 (1980), describes a different technique for the production of magnetite electrodes for use as insoluble anodes. The authors used a plasma jet spray technique for applying coatings of several spinel ferrites on titanium substrates for the production of insoluble anodes for cathodic protection. The coatings applied were up to about 50 μm thick. The behavior of these anodes were measured in sodium chlorode solutions. The magnetite anode was said to show the lowest polarization but a higher dissolution rate than other ferrites. A tantalum coating over the titanium substrate was said to generate improved adhesion between the ferrite coating layer and the substrate. The ceramic coatings were too thin and did not have enough adhesion to produce a durable anode.

SUMMARY OF THE INVENTION

It has now been found that highly acceptable anodes can be produced when the active anode materials are applied as a surface coating by plasma spraying over valve metals, such as titanium and niobium, that can be fabricated in any desired shape. The active anode materials are electron conducting ceramic materials are either ferrites or chromites. They are applied to a thickness of at least 10 mils (254 μm), and up to a thickness of about 0.125 inches (3.2 mm).

DETAILED DESCRIPTION OF THE INVENTION

Figure 2:
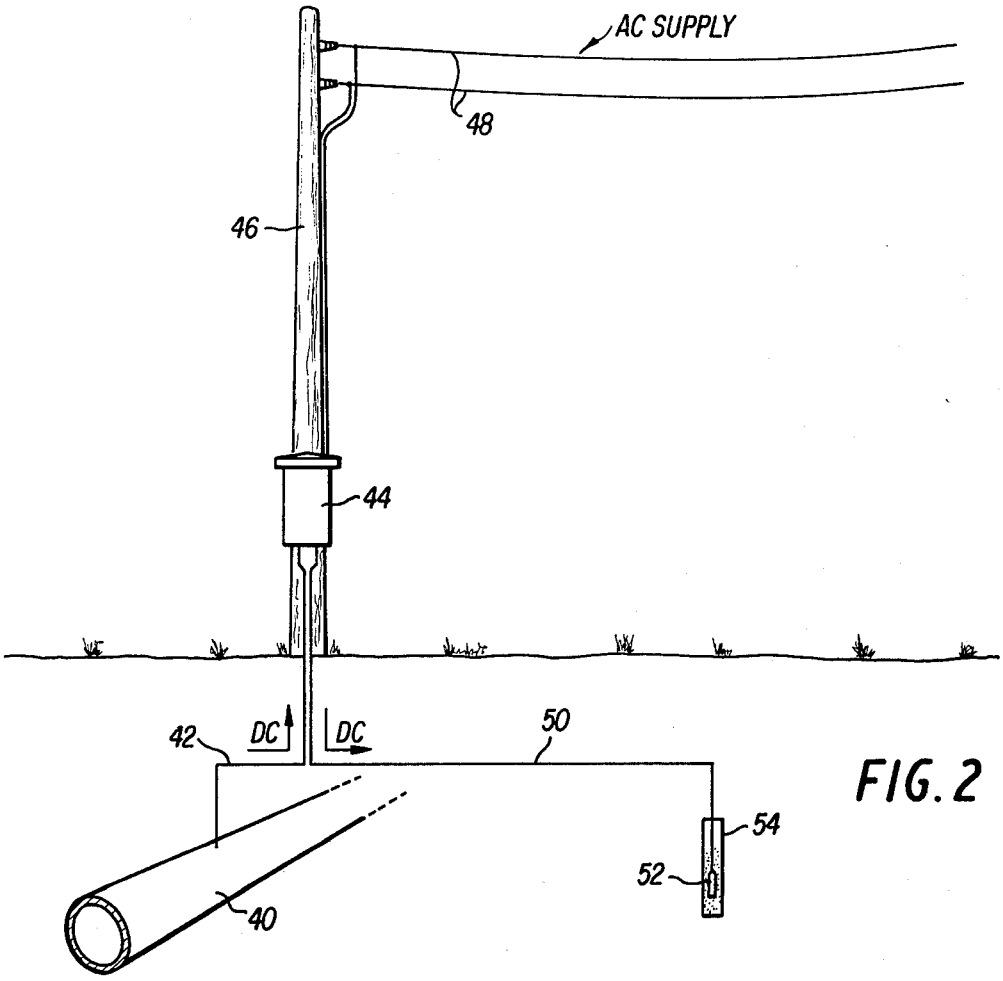
FIG. 2 is a schematic, fragmentary representation of an underground pipeline that is equipped with cathodic electroprotection including a ceramic anode in accordance with another embodiment of the invention.

Referring now in detail to the drawings by numerals of reference, a numeral 10 designates a fragmentary part of a structural member that is a part of the structure that is to be protected in accordance with the invention. This structural member 10 may be submerged in water 12 as shown, and may be for example a gate of a canal lock.

This structural member 10 is formed with an opening 14, and an anode 16 that is constructed in accordance with one embodiment of the invention is inserted in this opening 14 and is secured therein.

The anode 16 is formed with a generally cylindrical plastic body or mounting gland 18 that is proportioned to engage, preferably snugly, in the opening 14. The anode body 18 is formed with a peripheral shoulder 20 that butts against one face of the structural member 10. A preferred material for the construction of the plastic mounting gland 18 is an inert, strong structural engineering plastic such as, for example, Delrin polycarbonate. However, other inert and strong plastic materials are readily available and may be used for this purpose.

The plastic mounting gland 18 is formed at its outer end with an internally threaded recess 22. A screw-shaped cap 24 is threaded into the recess 22. This cap has a hemispherical-shaped head 26 that preferably is so proportioned as to engage against the outer face of the plastic mounting gland 18.

The outer surface of the hemispherical head 26 is covered with a plasma-sprayed layer of electron conducting ceramic 28. This layer is preferably about 20 mils thick, although in accordance with the invention it may have a thickness in the range from about 8 mils to about 0.125 inches, that is, from about 200 μm to about 3.2 mm.

At its opposite end, the plastic mounting gland 18 is formed with a reduced cylindrical extension 30 that is externally threaded. A washer 32 and nut 34 are mounted on this threaded end, to securely fasten the anode structure 16 to the structural member 10 that is to be protected.

The cap 24 is preferably formed from an inert but strong, electron conducting material, preferably titanium or niobium. It may also be constructed of tantalum or zirconium, or the like. Since these metals are relatively expensive, the amount used may be conserved by constructing the cap 24 to have an inverted brass plug portion 36. The brass plug may be secured within the titanium portion of the cap 24 in any suitable fashion, as by threading, but there must be good mechanical and electrical contact between these two parts if a plug is used.

The anode structure is also constructed with an axially extending bore within which an insulated electrically conductive wire 38 is inserted. The end of the wire within the anode structure is electrically connected and mechanically united in suitable fashion to the brass plug 36 or to the titanium metal itself if no brass is used. The purpose of the wire is to permit electrical connection to a source of positive D.C. potential.

The ceramic layer 28 is formed from any suitable inert, electron conducting ceramic material and is applied by plasma spraying. The preferred ceramic materials are magnesium-aluminum ferrite, lanthanum chromite, and lithium ferrite. Other materials that may be employed include the spinel-type ferrites formed from pure metallic oxides such as, for example, $Fe_2O_3$, NiO, and $Co_3O_4$. Different mixtures of these oxides can be formed into the ferrites represented by the formulae, $Ni_{1-x}Fe_{2+x}O_4$ and $Co_{1-x}Fe_{2+x}O_4$.

Ceramic coatings selected for use according to the invention should be sufficiently electron conducting to pass the required current while still maintaining an oxygen ion barrier to protect the substrate metal. In addition, these ceramic coatings present an active oxygen surface to the electrolyte, to allow oxidation to occur easily without degradation of the coating.

Titanium and niobium make excellent substrate metallic materials. Niobium is the material of choice for use as the substrate when the anode is intended for use in salt water, because of the high resistance of niobium to pitting. Titanium is the preferred material for those applications where the anode is in contact with ground water or soil, as in pipeline protection installations.

Figure 1:
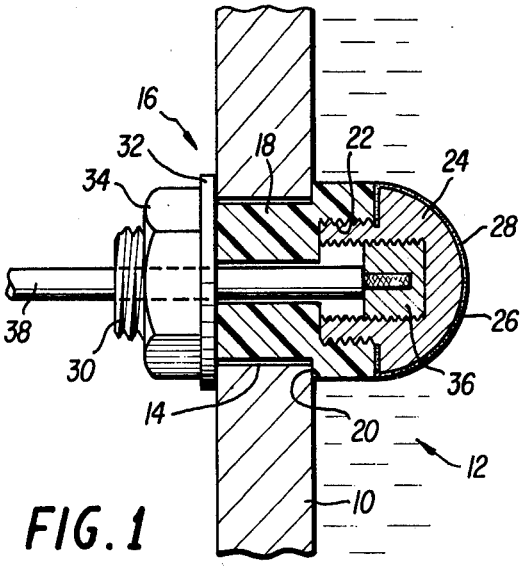
FIG. 1 is a fragmentary vertical section showing an anode constructed in accordance with one preferred embodiment of the invention, mounted through a structural member of a part of an underwater structure that is to be protected against corrosion.

Anodes constructed in accordance with the present invention are highly advantageous for off shore installations. The anode is simply installed in the manner shown in FIG. 1 and about 5 volts D.C. potential is applied through the insulated wire 38. Under the influence of the applied positive charge, the current leaves the surface of the anode and goes into the water. The material from the anode, that is, the ferrite or chromite ceramic layer, goes into the water and is consumed at a rate of about 1 gram of ceramic material per ampere per year. By way of contrast, silicon-iron and graphite used in the same kind of installation under essentially the same conditions experience losses on the order of about 1 pound per ampere per year. By way of further comparison, platinum loses about 6 mg. per ampere year but the cost is quite substantial.

Titanium and niobium substrate metals in particular have the advantage that if the ceramic coating layer is scratched to expose substrate metal, these substrates will passivate, so that the substrate protects itself.

Plasma spraying is the preferred technique for applying the ceramic layer. Plasma spraying applies good coatings of ceramic with good density and good adhesion to the substrate. However, in situ sintering is also a feasible process. However applied, the ceramic layer should have a substantial thickness to minimize the need for replacement, to insure uniform operation, and for sturdiness. Thus the thickness should be on the order indicated of 10 mils to about 0.125 inches.

The insulated wire 38 can be mechanically secured and sealed in place in any desired fashion. Many techniques for doing this are known. One preferred technique is to provide a radilly-extending bore that extends part way through the plastic mounting gland 18 and part way through the threaded portion 22 of the cap 24, to communicate with the axially-extending bore through the plastic mounting gland in which the insulated wire 38 is disposed. To seal the wire in place and to seal the gland, this bore can be filled (not shown in the drawing) by filling the hole with liquid epoxy resin that is then permitted to harden and cure.

In the installation for pipeline protection that is illustrated in FIG. 2, a pipeline 40 is buried beneath the surface of the ground. A wire 42 is welded or otherwise electrically and mechanically connected to the pipeline, and above ground the wire is connected to a rectifier unit 44 that is mounted on the pole 46 that supports the wires 48 of an A.C. supply. Another wire 50 interconnects the positive terminal of the rectifier 44 to an anode 52 that is constructed in accordance with one embodiment of the present invention. Preferably, this anode is buried beneath the surface of the ground but is placed within a protective casing 54 packed with carbonaceous material that permits the anode to communicate electrically with the ground and moisture in the ground and has an effective larger surface area.

When the ceramic coating is applied in the preferred thickness range of from about 10 mils to about 20 mils, the resistivity of the ceramic coating is generally less than about 500 ohm-cm., and the dissolution rate is generally less than 10 grams per ampere year, and often is about 1 gram per ampere year, when the applied positive D.C. potential is the usual range of from about 5 to about 15 volts.

Metal-ceramic anodes constructed in accordance with the invention have several advantages over the perior art anodes. Thus, the valve metal substrates, such as titanium, can be fabricated readily by known techniques into any desired shape or form. Application of the ceramic coating by plasma spraying can apply the ceramic coating to a substrate of any shape. Anodes constructed in accordance with the invention are characterized by small loss, and therefore may be made with smaller size than was possible in the past. They may also be manufactured in a central factory so as to require very little field fabrication, thereby increasing the reliability of the cathodic protection system. Moreover, the small size that is permissible for anodes constructed according to the invention makes their shipment and replacement easier and of lower cost.

While the invention has been disclosed in this patent application by reference to the details of preferred embodiments of the invention, it is to be understood that this disclosure is intended in an illustrative rather than in a limiting sense, as it is contemplated that modifications will readily occur to those skilled in the art, within the spirit of the invention and the scope of the appended claims.

What is claimed is:

1. An anode useful in corrosion protection of a metal structure wherein an electric current is passed between the anode and the metal structure, said anode comprising a metallic substrate having an applied layer thereon from which layer the current will flow from said anode, said layer being formed from lithium ferrite, and said layer having metallic electronic conductivity and a thickness of at least about 8 mils.

2. The anode of claim 1 wherein said applied layer has been applied by plasma spraying to a thickness in the range from 10 mils to about 0.125 inches, for durability and stability.

3. A metal-ceramic anode useful in cathodic electroprotection, according to claim 1, wherein the metallic substrate is selected from the group consisting of titanium and niobium metals of 98% to 100% purity and the apppled layer has been applied by plasma spraying to a thickness in the range from 10 mils to about 0.125 inches.

4. In a process for the prevention of corrosion of a metal structure, wherein an electric current is passed between an anode and the metal structure, the improvement wherein said anode comprises a metallic substrate having an applied layer thereon from which current flows from said anode, said layer being formed from lithium ferrite, and said layer having metallic electronic conductivity and a thickness of at least about 8 mils.

5. The process ofclaim 4 wherein said substrate is formed of niobium or titanium of 98% to 100% purity.

6. The process of claim 5 wherein said layer is a plasma-sprayed layer having a thickness of 10 mils to 0.125 inches.

7. The process of claim 4 wherein said layer is a plasma-sprayed layer having a thickness of 10 mils to 0.125 inches.

* * * * *